US008360570B2

(12) United States Patent
Shindo

(10) Patent No.: US 8,360,570 B2
(45) Date of Patent: Jan. 29, 2013

(54) INKJET PRINTER WHICH PREVENTS DISPELLED INK FROM THE INKJET HEAD FROM STAINING BOTH THE MEDIUM AND THE PLATEN

(75) Inventor: Tatsuya Shindo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 889 days.

(21) Appl. No.: 12/286,425

(22) Filed: Sep. 30, 2008

(65) Prior Publication Data

US 2009/0122098 A1 May 14, 2009

(30) Foreign Application Priority Data

Oct. 1, 2007 (JP) ..... 2007-257460

(51) Int. Cl.
*B41J 2/01* (2006.01)

(52) U.S. Cl. ..... 347/102; 347/101

(58) Field of Classification Search ..... 347/5, 8, 347/16, 17, 101, 102, 104
See application file for complete search history.

(56) References Cited

U.S. PATENT DOCUMENTS

| | | | | |
|---|---|---|---|---|
| 5,467,119 | A * | 11/1995 | Richtsmeier et al. | 347/102 |
| 5,479,199 | A * | 12/1995 | Moore et al. | 347/102 |
| 5,510,822 | A * | 4/1996 | Vincent et al. | 347/102 |
| 5,668,584 | A * | 9/1997 | Broder et al. | 347/102 |
| 5,774,155 | A * | 6/1998 | Medin et al. | 347/102 |
| 6,336,722 | B1 * | 1/2002 | Wotton et al. | 347/102 |
| 6,397,021 | B2 * | 5/2002 | Hayashi et al. | 399/69 |
| 6,454,478 | B2 * | 9/2002 | Wotton et al. | 400/656 |
| 6,511,147 | B2 * | 1/2003 | Kubota et al. | 347/16 |
| 6,709,088 | B2 * | 3/2004 | Hayakawa et al. | 347/31 |
| 6,991,314 | B2 | 1/2006 | Hayakawa et al. | |
| 7,802,882 | B2 * | 9/2010 | Haba | 347/102 |
| 7,806,524 | B2 * | 10/2010 | Watanabe et al. | 347/104 |
| 7,832,851 | B2 * | 11/2010 | Murase | 347/101 |
| 2003/0011669 | A1 * | 1/2003 | Tsuboi et al. | 347/102 |
| 2005/0190248 | A1 * | 9/2005 | Konno et al. | 347/102 |
| 2006/0082632 | A1 * | 4/2006 | Kinoshita | 347/105 |
| 2006/0232621 | A1 * | 10/2006 | Hayamizu et al. | 347/19 |
| 2006/0237417 | A1 * | 10/2006 | Kagawa et al. | 219/216 |
| 2007/0166084 | A1 * | 7/2007 | Yoshino et al. | 399/329 |
| 2007/0291099 | A1 * | 12/2007 | Furuyama | 347/212 |
| 2008/0018690 | A1 * | 1/2008 | Nishida | 347/18 |

FOREIGN PATENT DOCUMENTS

| | | |
|---|---|---|
| JP | 2001-301201 | 10/2001 |
| JP | 2002-086760 | 3/2002 |
| JP | 2003-285433 | 10/2003 |

* cited by examiner

*Primary Examiner* — Julian Huffman
*Assistant Examiner* — Sharon A Polk
(74) *Attorney, Agent, or Firm* — Frommer Lawrence & Haug LLP

(57) ABSTRACT

An inkjet printer is provided. The inkjet printer includes inkjet head for ejecting ink; a positioning unit which positions a recording medium at a recording position to which the ink is ejected from the inkjet head; a platen which supports the recording medium positioned at the recording position from an opposite side of the inkjet head; a heater which heats the platen at a position corresponding to at least an end portion of the recording medium positioned at the recording position; and a control unit which controls the heater to turn on and off.

14 Claims, 7 Drawing Sheets

INKJET PRINTER WHICH PREVENTS DISPELLED INK FROM THE INKJET HEAD FROM STAINING BOTH THE MEDIUM AND THE PLATEN

CROSS-REFERENCE TO RELATED APPLICATION

This application claims priority from Japanese Patent Application No. 2007-257460, filed on Oct. 1, 2007, the entire subject matter of which is incorporated herein by reference.

TECHNICAL FIELD

Aspects of the present invention relates to an inkjet printer.

BACKGROUND

An inkjet printer having a borderless printing function forms an image on the entire surface of a sheet as a recording medium without leaving a margin on the peripheral edge part thereof (for example, JP-A-2001-301201). In this borderless printing, since it is difficult to eject ink drops just on the peripheral edge of a sheet due to a positioning accuracy of the sheet being conveyed, ink drops are ejected in excess to the outside of the sheet so as not to leave a margin on the peripheral edge part of the sheet.

Meanwhile, the ink drops ejected to outside of the sheet are to be deposited on a platen that supports the sheet being conveyed, and thus the deposited ink may stain a sheet to be conveyed next. Since a general platen supports a sheet on upper ends of ribs protruding from a flat plate portion, it is conceivable to increase the amount of protrusion of the ribs so as to prevent side end portions of the sheet from contacting the ink on the flat plate portion of the platen. However, the distance between the flat plate portion of the platen and the sheet increases as the amount of protrusion of the ribs is increased. Accordingly, the flying distance of ink drops ejected to outside of the sheet when ink drops are ejected on the flat plate portion of the platen not on the sheet becomes longer than the flying distance of ink drops when ink drops are ejected on the sheet. Therefore, flying drops becomes more likely to be atomized into mist. Moreover, there is a concern that the ink drops atomized into mist may float without instantly landing to stain the back surface of the sheet and the interior of the printer device.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a suitable configuration which does not stain a recording medium.

According to an exemplary embodiment of the present invention, there is provided an inkjet printer including: an inkjet head for ejecting ink; a positioning unit which positions a recording medium at a recording position to which the ink is ejected from the inkjet head; a platen which supports the recording medium positioned at the recording position from an opposite side of the inkjet head; a heater which heats the platen at a position corresponding to at least an end portion of the recording medium positioned at the recording position; and a control unit which controls the heater to turn on and off.

According to another exemplary embodiment of the present invention, there is provided an inkjet printer including: an inkjet head for ejecting ink on a recording medium; a platen which is provided opposite to the inkjet head and supports the recording medium; and a heater which heats the platen.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, exemplary embodiments according to the present invention will be described with reference to the drawings. Also, in the following description, the direction in which ink is ejected from an inkjet head is taken assumed to be downward, and the opposite direction thereof is assumed to be upward.

(First Exemplary Embodiment)

Figure 1:
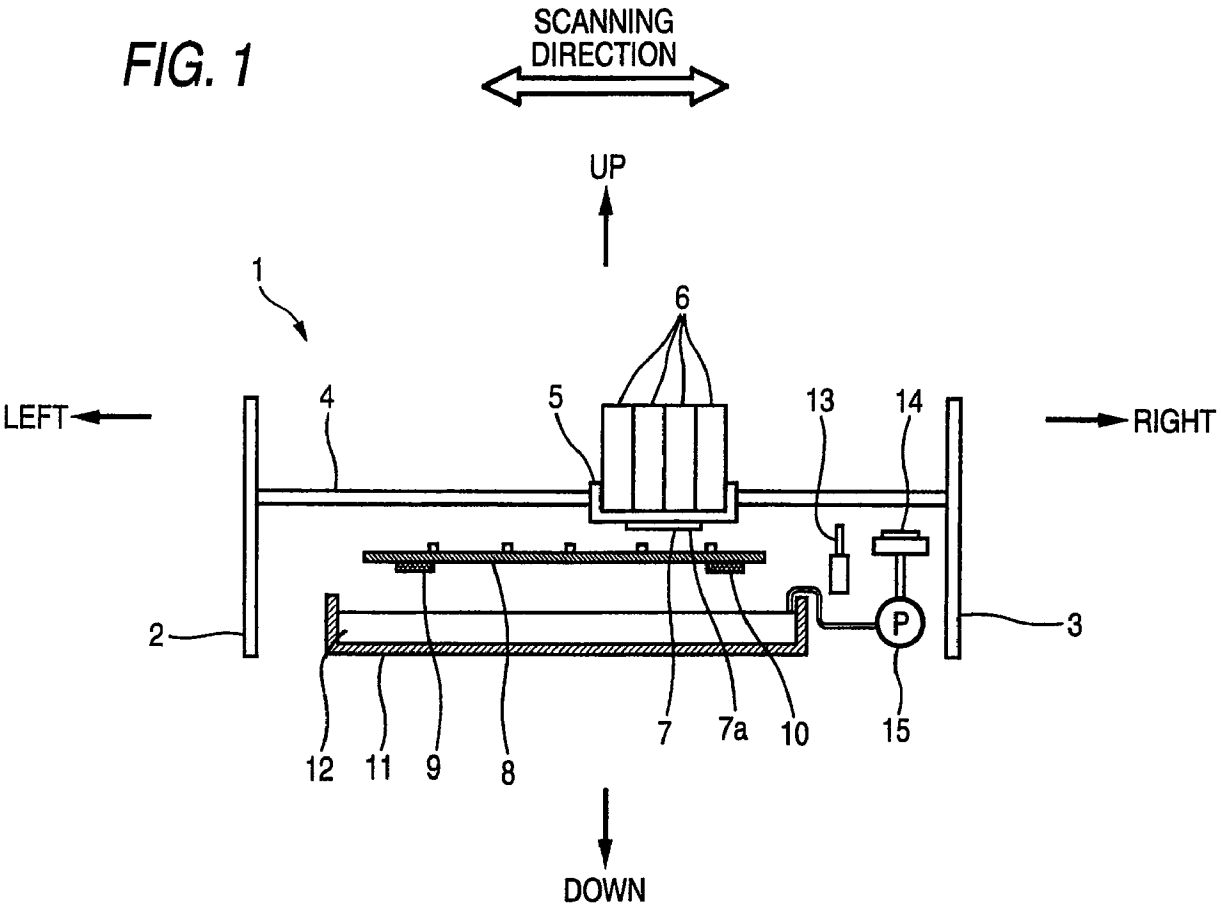
FIG. 1 is a front view of an inkjet printer according to the first exemplary embodiment of the present invention.

FIG. 1 is a front view of an inkjet printer 1 according to a first exemplary embodiment of the present invention. As shown in FIG. 1, the inkjet printer 1 includes a guide shaft 4 supported on left and right frames 2 and 3 and extending in the left and right direction. The guide shaft 4 supports a carriage 5 so as to be slidable in the left and right direction (scanning direction). The carriage 5 is joined to a timing belt (not shown) that reciprocates in the left and right direction. Then, the carriage 5 performs reciprocating scanning in the left and right direction as the timing belt is reciprocated by a carriage drive motor 32 (see FIG. 4).

On the upper side of the carriage 5, four ink cartridges 6 corresponding to four color inks (black, cyan, magenta, and yellow), respectively, are detachably mounted. On the lower side of the carriage 5, an inkjet head 7 is attached. The inkjet head 7 includes a nozzle face 7*a* formed with nozzles to eject ink at a lower face thereof. That is, ink is ejected from the nozzles of the inkjet head 7 toward the surface of a sheet 17 (see FIG. 2) as a recording medium being conveyed in the front and rear direction (conveying direction) orthogonal to the scanning direction below the inkjet head 7.

Below the inkjet head 7, a platen 8 is provided. The platen 8 extends in the scanning direction and supports the sheet 17 from the back surface side at a recording position as a print area. The platen 8 includes heaters 9 and 10 attached from lower side thereof, which will be described later in detail. Below the platen 8, a waste ink tank 11 which has opening at an upper face thereof is provided. The waste ink tank 11 houses a waste ink absorbing member 12 formed of a porous member. It is noted that in this application, any member which is provided opposite the inkjet head 7 and supports a sheet being conveyed is referred to as platen. Each heater 9, 10 includes a heating wire and generate heat by applying a power to heating wire. However, any device generates heat on the platen 8 may be a heater of the present invention. Also, the heater may not be attached to the platen directly. For example, an infrared emitting unit which emits infrared is capable of generating heat on the platen 8.

In a maintenance region where printing is not performed, a wiper blade 13 and a suction cap device 14 are provided. The wiper blade 13 is formed of an elastic plate of rubber and the like, and is configured to be able to wipe the nozzle face 7*a* of the inkjet head 7 when the carriage 5 is moved toward the suction cap device 14. The suction cap device 14 is raised by a driving unit (not shown) so that the nozzle face 7*a* of the inkjet head 7 can be sealed when the inkjet head 7 is moved right above the suction cap device 14. Below the suction cap device 14, a suction pump 15 is arranged, which applies a negative pressure to a sealing space of the suction cap device 14. The suction cap device 14 functions not only as a cap to prevent the nozzles of the inkjet head 7 from drying during suspension of printing but also to perform a purge operation. In the purge operation, the negative pressure from the suction pump 15 acts on the nozzles of the inkjet head 7 to cause a negative-pressure suction of dry ink, foreign matter, and the like from the nozzles. Thus, the ink ejected to the inside of the suction cap device 14 is sent by the suction pump 15 to the waste ink tank 11, and absorbed by the waste ink absorbing member 12 housed in the waste ink tank 11.

Figure 2:
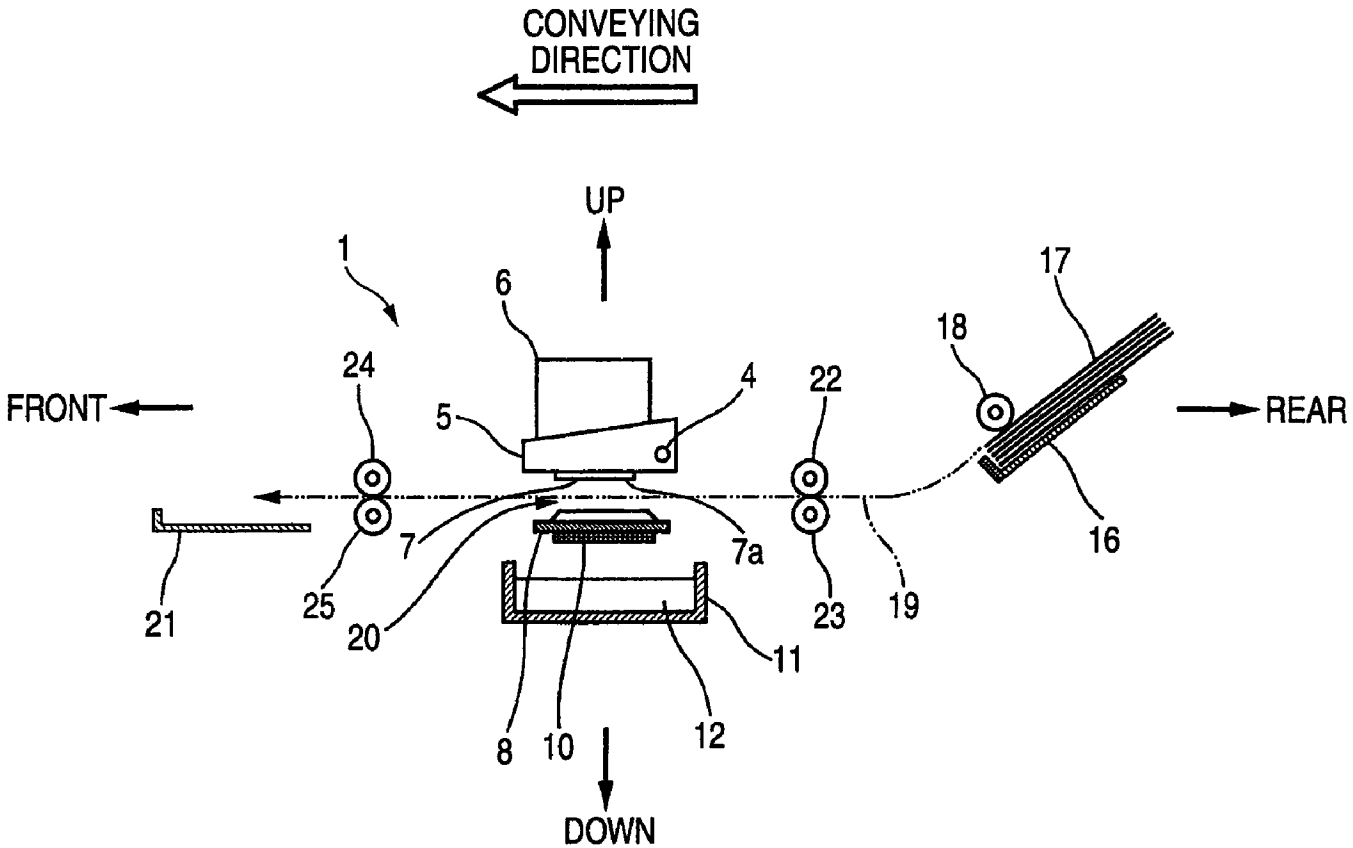
FIG. 2 is a side view of the inkjet printer shown in FIG. 1.

FIG. 2 is a side view of the inkjet printer 1 shown in FIG. 1. As shown in FIG. 2, a sheet feeding tray 16 is provided in the rear part of the inkjet printer 1. At an opposed position of the sheet feeding tray 16, a feed drive roller 18 is provided. The feed drive roller 18 feeds the uppermost one of the sheets 17 stacked on a sheet feeding tray 16 to a conveying path 19. The conveying path 19 is directed to a sheet discharging tray 21 forward from the lower end of the sheet feeding tray 16 through a recording position 20.

At an upstream side of the inkjet head 7, a conveying roller 22 and a pinch roller 23 are provided. The conveying roller 22 and the pinch roller 23 pinch the sheet 17 fed into the conveying path 19 and convey the sheet 17 onto the platen 8 in the recording position 20. At a downstream side of the inkjet head 7, a discharge roller 24 and a pinch roller 25 are provided. The discharge roller 24 and the pinch roller 25 pinch the printed sheet 17 and convey the printed sheet 17 to the sheet discharging tray 21. That is, the sheet feeding tray 16, the feed drive roller 18, the conveying roller 22, the pinch roller 23, the discharge roller 24, and the pinch roller 25 convey the sheet 17 while positioning the sheet 17 at the recording portion 20 to which ink from the inkjet head 7 can be ejected.

The inkjet head 7 includes a flow path unit (not shown) having a plurality of flow paths (not shown) to guide ink that flows from the ink cartridges 6 to a plurality of nozzles (not shown) formed at the nozzle face 7*a* and a piezoelectric-driven actuator that selectively imparts an ejection pressure to the ink in the flow paths of the flow path unit toward the nozzles.

Figure 3:
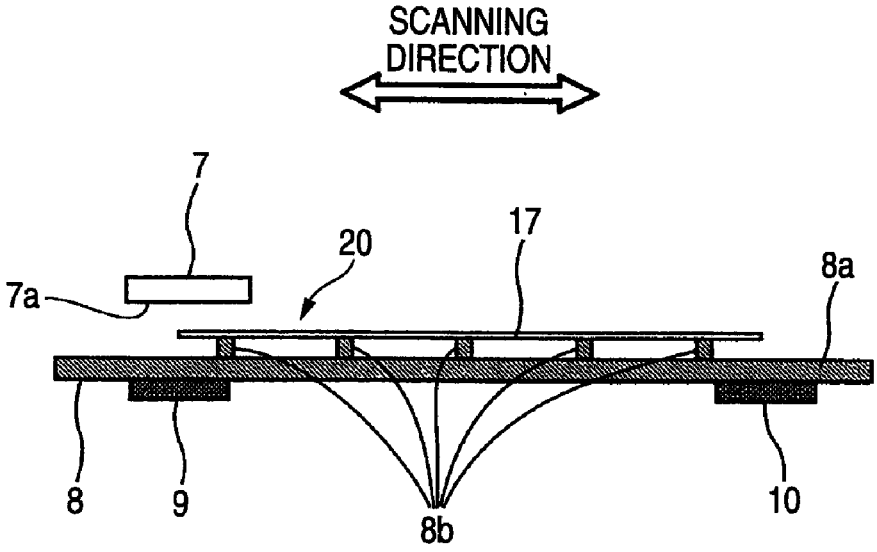
FIG. 3 is a front view showing a platen and heaters of the inkjet printer shown in FIG. 1.

FIG. 3 is a front view showing the platen 8 and the heaters 9 and 10 of the inkjet printer 1 shown in FIG. 1. As shown in FIG. 3, the platen 8 includes a flat plate portion 8*a* opposed to the nozzle face 7*a* of the inkjet head 7 and a plurality of ribs 8*b* protruding upward at intervals in the scanning direction from the flat plate portion 8*a*, and is integrally molded of a resin (for example, polypropylene and the like). The ribs 8*b* may be provided according to sizes of the sheets to be used in the inkjet printer 1 so that the platen 8 surely supports the sheets and end portions of sheets are not bent downwardly to a large extent even when the plurality sizes of sheets are conveyed. The sheet 17 on which the inkjet head 7 ejects ink is supported by the upper ends of the ribs 8*b* of the platen 8. Furthermore, on the lower face of the flat plate portion 8*a* of the platen 8, the heater 9, 10 is directly attached (heat-transmittably connected) at a position corresponding to an end portion 17*a* of the sheet 17 (for example, A4 size) positioned at the recording position 20. That is, when the heater 9, 10 generates heats, in the flat plate portion 8*a* of the platen 8, mainly a position corresponding to the end portion 17*a* of the sheet 17 is heated.

Figure 4:
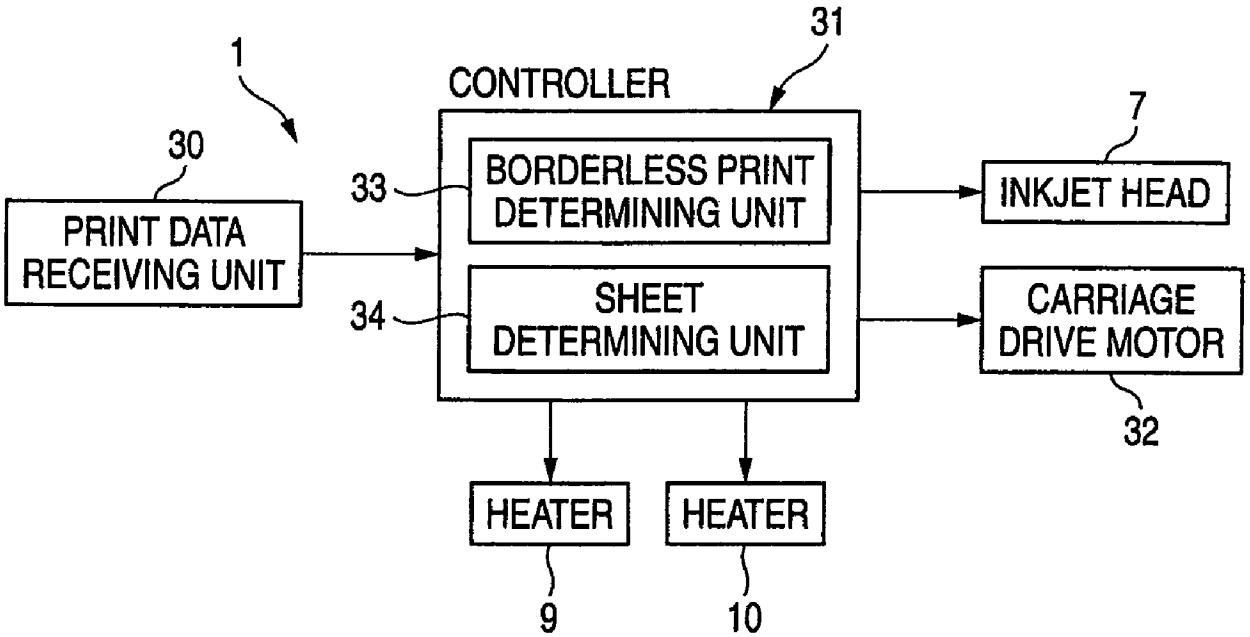
FIG. 4 is a block diagram showing a control system of the inkjet printer shown in FIG. 1.

FIG. 4 is a block diagram showing a control system of the inkjet printer 1 shown in FIG. 1. As shown in FIG. 4, the inkjet printer 1 includes a print data receiving unit 30, a controller 31, the inkjet head 7, a carriage drive motor 32, and the heaters 9 and 10. The print data receiving unit 30 receives print data transmitted from an externally connected personal computer (not shown) and the like. The print data received by the print data receiving unit 30 contains image data, borderless printing instruction data, sheet type data, and the like.

The controller 31 controls operations of the inkjet head 7, the carriage drive motor 32, and the heaters 9 and 10 according to the print data from the print data receiving unit 30. The controller 31 includes a borderless printing determining unit 33 and a sheet determining unit 34. The borderless printing determining unit 33 determines whether the print data from the print data receiving unit 30 contains borderless printing instruction data. The sheet determining unit 34 determines whether the sheet to be a print target has a high flexibility (low rigidity) based on sheet type data included in the print data from the print data receiving unit 30. For example, the sheet determining unit 34 determines that the sheet to be a print target has a high flexibility (low rigidity) when the type of the sheet is a plain paper or the like, and determines that the sheet has low flexibility (high rigidity) when the sheet is a glossy paper, exclusive paper, or the like.

Figure 5:
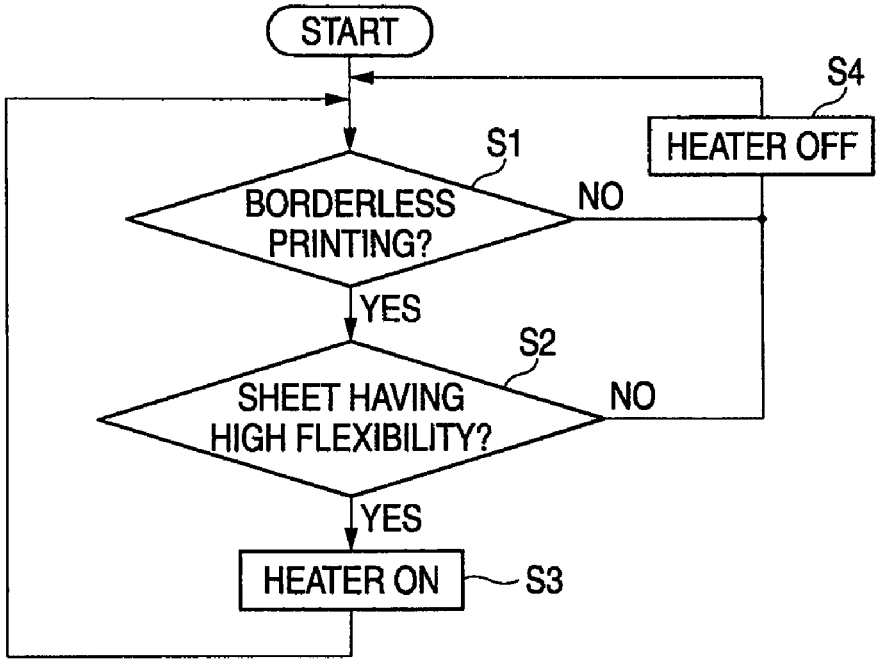
FIG. 5 is a flowchart explaining control of the inkjet printer shown in FIG. 1.
Figure 6:
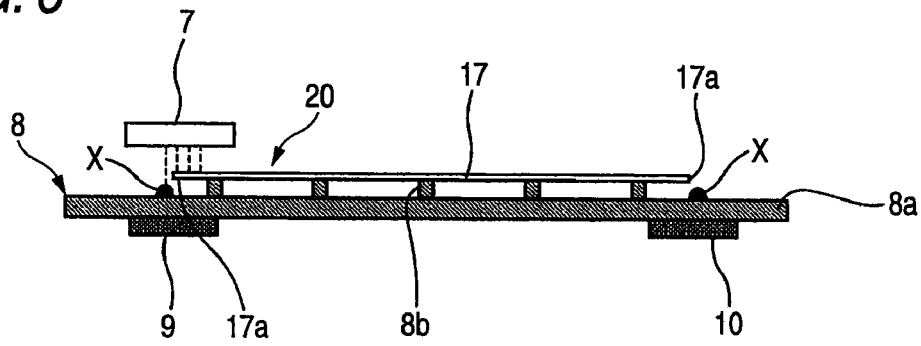
FIG. 6 is a front view of a first step for explaining borderless printing by the inkjet printer shown in FIG. 1.
Figure 7:
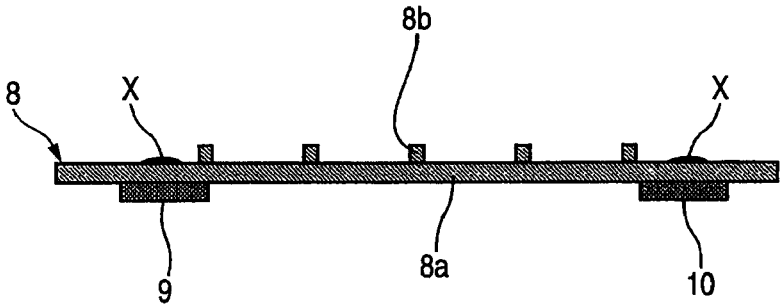
FIG. 7 is a front view of a second step for explaining borderless printing by the inkjet printer shown in FIG. 1.
Figure 8:
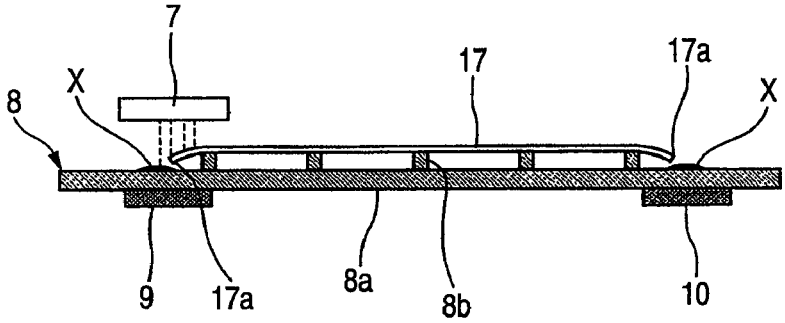
FIG. 8 is a front view of a third step for explaining borderless printing by the inkjet printer shown in FIG. 1.

Next, description will be given of a borderless printing operation of the inkjet printer 1 along the flow of FIG. 5 while appropriately referring to FIGS. 4 and 6 to 8. FIG. 5 is a flowchart explaining control of the inkjet printer 1 shown in FIG. 1. FIG. 6 is a front view of the first step for explaining borderless printing by the inkjet printer 1 shown in FIG. 1. FIG. 7 is a front view of the second step for explaining the borderless printing. FIG. 8 is a front view of the third step for explaining borderless printing.

As shown in FIG. 4 and FIG. 5, when the inkjet printer 1 receives print data by the print data receiving unit 30, the borderless print determining unit 33 of the controller 31 determines whether the print data includes borderless printing instruction data at operation S1. If the borderless print determining unit 33 determines that the print data does not include borderless printing instruction data and the printing to be executed from then is not borderless printing, the controller 31 keeps the heaters 9 and 10 off at operation S4, and the process returns to operation S1.

On the other hand, if the borderless print determining unit 33 determines that the print data includes borderless printing instruction data and it is determined that the printing to be executed from then is borderless printing, the sheet determining unit 34 determines whether the sheet to be a print target has high flexibility based on sheet type data included in the print data at operation S2. If the sheet determining unit 34 determines that the sheet to be a print target does not have high flexibility, the controller 31 keeps the heaters 9 and 10 off at operation S4, and the process returns to operation S1. On the other hand, if the sheet determining unit 34 determines that the sheet to be a print target has high flexibility, the controller 31 turns on the heaters 9 and 10 at operation S3, and the process returns to operation S1.

Specifically, as shown in FIG. 6, when borderless printing is performed for the sheet 17 of plain paper conveyed onto the ribs 8*b* of the platen 8, for executing the printing without leaving a margin in the end portion 17*a* of the sheet 17, ink from the inkjet head 7 is ejected to spread outside of the end portion 17*a* of the sheet 17, and ink X is deposited on the flat plate portion 8*a* of the platen 8. In this case, as shown in FIG. 7, the heater 9, 10 is on, and the position corresponding to the end portion 17*a* of the sheet 17 in the flat plate portion 8*a* of the platen 8 has been heated, and thus the ink X dries before a next sheet is conveyed. Then, as shown in FIG. 8, when the sheet 17 of plain paper to be conveyed next onto the ribs 8*b* of the platen 8 to have a large print duty ratio, the sheet 17 is easily bent downwardly by absorbing a large amount of ink. However, since the ink X has dried even when the end portion 17*a* of the sheet 17 bent to approach the flat plate portion 8*a* of the platen 8, the end portion 17*a* of the sheet 17 is prevented from being stained by the ink X.

According to the above configuration, even when the ink ejected from the inkjet head 7 spreads outside of the end portion 17*a* of the sheet 17, by turning on the heater 9, 10 to heat the platen 8, the over-spread ink X can be immediately dried. With this configuration, the over-spread ink X would not be deposited on the end portion 17*a* of the sheet 17 to be printed next, so that it becomes possible to prevent a stain of the sheet 17 by a simple configuration. Furthermore, since the heater 9, 10 are provided at the positions corresponding to the respective end portions 17*a* of the sheet 17 positioned at the recording position 20 in the platen 8, this allows heating in a concentrated manner the ink X that has spread outside of the end portion 17*a* of the sheet 17 and ejected on the flat plate portion 8*a* of the platen 8, so that it becomes possible to efficiently dry the ink.

Moreover, since the heater 9, 10 is turned on only for borderless printing in which ink from the inkjet head 7 is ejected outside of the sheet 17, the heater 9, 10 is not wastefully turned on. Accordingly, a rise in temperature in the printer body and an increase in power consumption can be suppressed. Furthermore, since the heater 9, 10 is turned on when the sheet 17 has high flexibility and the heater 9, 10 is not turned on when the sheet 17 has low flexibility and the end portion 17*a* thus does not easily contact the flat plate portion 8*a* of the platen 8, wasteful heating can be further reduced.

(Second Exemplary Embodiment)

Figure 9:
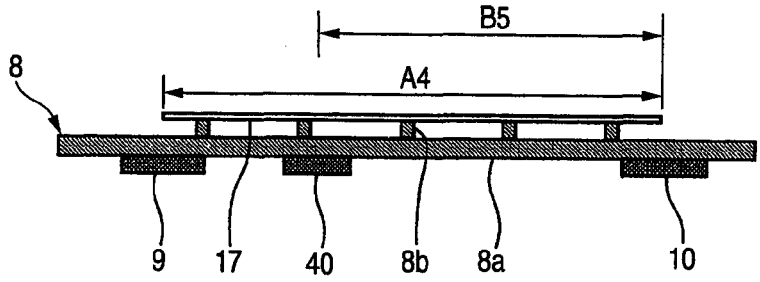
FIG. 9 is a front view showing a platen and heaters of an inkjet printer according to a second exemplary embodiment of the present invention.

FIG. 9 is a front view showing a platen 8 and heaters 9, 10, and 40 of an inkjet printer according to a second exemplary embodiment of the present invention. As shown in FIG. 9, according to the present exemplary embodiment, the heater 9, 10 is provided in the back surface of a flat plate portion 8*a* of the platen 8, at positions corresponding to the end portions of a sheet 17 of A4 size, and the heater 40 is also provided at a position corresponding to the end portion of a sheet of B5 size smaller in area than A4 size. That is, the heaters 9, 10, 40 are provided at positions corresponding to end portions of the plurality of sizes of sheets. In addition, a controller of the present exemplary embodiment equivalent to the controller 31 in FIG. 4 turns on the heaters 9 and 10 at the positions corresponding to the end portions of a sheet of A4 size when the size of a sheet to be a print target is A4. Moreover, the controller turns on the heaters 10 and 40 located at the positions corresponding to the end portions of a sheet of B5 size when the size of a sheet to be a print target is B5. That is, the controller determines a size of the sheet to be printed based on the sheet type data included in the print data and selectively turns on the heaters 9, 10 and 40 at the positions corresponding to the determined size of the sheet to be printed. In other words, the controller controls each of the heaters 9, 10 and 40 to turn on and off based on a recording area, which is determined according to the print data.

According to the above configuration, the heaters 9 and 10 or 10 and 40 to be heated are selected according to the sheet size, and therefore, it becomes possible to efficiently dry ink without wastefully heating the platen 8. It is noted that other configuration is similar to that of the first exemplary embodiment described above, and thus description thereof is omitted.

(Third Exemplary Embodiment)

Figure 10:
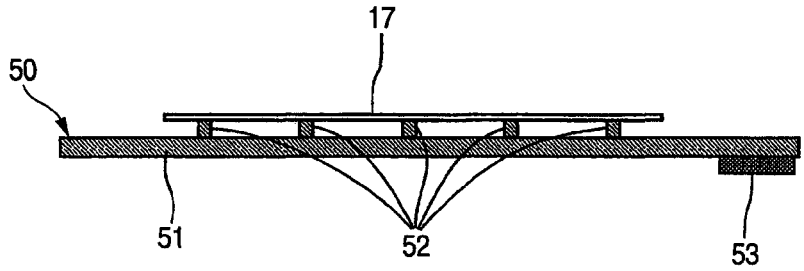
FIG. 10 is a front view showing a platen and a heater of an inkjet printer according to a third exemplary embodiment of the present invention.

FIG. 10 is a front view showing a platen 50 and a heater 53 of an inkjet printer according to a third exemplary embodiment of the present invention. As shown in FIG. 10, a flat plate portion 51 of the platen 50 of the present exemplary embodiment is formed of a metal such as aluminum having high heat conductivity. To the surface of the flat plate portion 51 of the platen 50, ribs 52 made of a resin or a metal are connected as a separate member. To the back surface of the flat plate portion 51 of the platen 50, the heater 53 is attached at a position not corresponding to the end portion of a sheet 17. For example, the single heater 53 is directly attached to the back surface of an end portion of the flat plate portion 51 of the platen 50.

According to the above configuration, since the flat plate portion 51 of the platen 50 is formed of a metal having high heat conductivity, heat from the heater 53 can be evenly transmitted to the flat plate portion 51, and ink on the flat plate portion 51 of the platen 50 can be efficiently dried. It is noted that, other configuration is similar to that of the first exemplary embodiment described above, and thus description thereof is omitted.

(Fourth Exemplary Embodiment)

Figure 11:
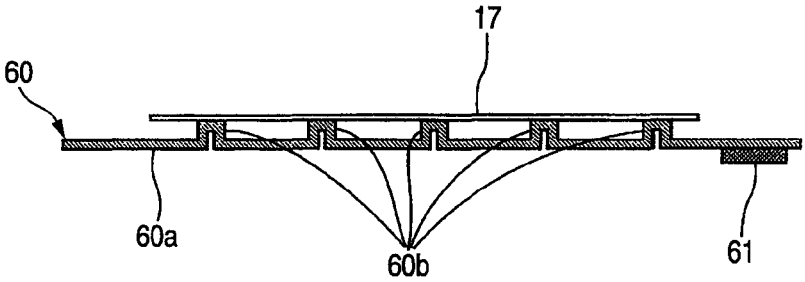
FIG. 11 is a front view showing a platen and a heater of an inkjet printer according to a fourth exemplary embodiment of the present invention.

FIG. 11 is a front view showing a platen 60 and a heater 61 of an inkjet printer according to a fourth exemplary embodiment of the present invention. As shown in FIG. 11, the platen 60 of the present exemplary embodiment is integrally formed of a metal such as aluminum having high heat conductivity. For example, the platen 60 having a plurality of ribs 60*b* protruding upward from a flat plate portion 60*a* is formed by pressing a metal plate. To the back surface of the flat plate portion of the platen 60, the heater 61 is attached at a position not corresponding to the end portion of a sheet 17. For example, the single heater 61 is directly attached to the back surface of an end portion of the flat plate portion 60*a* of the platen 60.

According to the above configuration, since the platen 60 as a whole is made of metal, heat from the heater 61 provided on the flat plate portion 60*a* can be efficiently transmitted also to the ribs 60*b*, and even when ink is deposited on the tip ends of the ribs 61*b*, the ink can be immediately dried. It is noted that other configuration is similar to that of the first exemplary embodiment described above, and thus description thereof is omitted.

As in the above, an inkjet printer according to the present invention has an excellent effect of preventing a stain of a recording medium, and the present invention may be advantageous when being widely applied to an inkjet printer capable of enjoying the effect of the present invention.

While the present invention has been shown and described with reference to certain exemplary embodiments thereof, it will be understood by those skilled in the art that various changes in form and details may be made therein without departing from the spirit and scope of the invention as defined by the appended claims.

In the above exemplary embodiments, an image is formed while the inkjet head 7 reciprocates in the scanning direction. However, the inventive concept of the present invention is not limited thereto. For example, a line-type inkjet head may be used, which extends over a print area and forms an image without moving.

What is claimed is:

1. An inkjet printer comprising:
an inkjet head for ejecting ink;
a conveying unit which conveys a recording medium to the inkjet head;
a positioning unit which positions a recording medium at a recording position to which the ink is ejected from the inkjet head;
a platen which supports the recording medium positioned at the recording position from an opposite side of the inkjet head;
a heater which heats the platen at a position corresponding to at least an end portion of the recording medium positioned at the recording position; and
a control unit which controls the heater to turn on and off;
wherein the control unit determines a size of the recording medium conveyed by the conveying unit from among a plurality of size of recording media in a width direction orthogoal to a conveying direction of the recording medium by the conveying unit;
wherein the heater includes a plurality of heaters provided at positions corresponding to end porition of the plurality of sizes of recording media positioned at the recording position in a width direction, respectively;
wherein the control unit selectively turns on the heaters based on the size of the recording medium determined by the control unit;
wherein the control unit determines whether a borderless printing command of controlling the inkjet head to eject ink up to the end portions of the recording medium is received;
wherein the control unit turns on the heater when it is determined that the borderless printing command is received; and
wherein the control unit does not turn on the heater when it is determined that a bordered printing command is received.

2. The inkjet printer according to claim 1;
wherein the heater is directly or indirectly connected to the platen in such a way so as to transmit heat from the heater to the platen.

3. The inkjet printer according to claim 2;
wherein the heater is provided on the platen at a position corresponding to the at least the end portion of the recording medium positioned at the recording position.

4. The inkjet printer according to claim 3;
wherein the control unit selectively turns on the heaters located at positions corresponding to end portions of the determined size of the recording medium to be printed.

5. The inkjet printer according to claim 2;
wherein the platen is made of a metal.

6. The inkjet printer according to claim 5;
wherein the platen includes:
a flat plate portion opposed to the inkjet head; and
a rib protruding from the flat plate portion toward the inkjet head to support the recording medium; and
wherein the heater is provided on the flat plate portion.

7. The inkjet printer according to claim 1;
wherein the control unit determines whether the recording medium to be printed has high flexibility; and
wherein the control unit turns on the heater when it is determined that the recording medium to be printed has high flexibility.

8. The inkjet printer according to claim 1;
wherein the control unit determines whether the recording medium to be printed has high flexibility based on a type of the recording medium.

9. The inkjet printer according to claim 1;
wherein the inkjet head ejects ink at a position in which the ink reaches outside of the recording medium to be printed.

10. An inkjet printer comprising:
an inkjet head for ejecting ink on a recording medium;
a conveying unit which conveys a recording medium to the inkjet head;
a platen which is provided opposite to the inkjet head and supports the recording medium;
a heater which heats the platen; and
a control unit which controls the heater to turn on and off;
wherein the control unit determines a size of the recording medium conveyed by the conveying unit from among a plurality of sizes of recording media in a width direction orthogonal to a conveying direction of the recording medium by the conveying unit;
wherein the heater includes a plurality of heaters provided at positions corresponding to end portions of the plurality of sizes of recording media in a width direction, respectively;
wherein the control unit selectively turns on the heaters based on the size of the recording medium determined by the control units;
wherein the control unit determines whether a borderless printing command of controlling the inkjet head to eject ink up to the end portions of the recording medium is received;
wherein the control unit turns on the heater when it is determined that the borderless printing command is received; and
wherein the control unit does not turn on the heater when it is determined that a bordered printing command is received.

11. The inkjet printer according to claim 10;
wherein the heater is attached to the platen.

12. The inkjet printer according to claim 11;
wherein the plurality of heaters is attached to the platen.

13. The inkjet printer according to claim 12, further comprising:
a control unit which controls the inkjet head to form an image in a recording area.

14. The inkjet printer according to claim 13;
wherein the control unit receives print data;
wherein the control unit controls the inkjet head to form the image in an recording area, the recording area being determined according to the print data; and
wherein the control unit controls each of the plurality of heaters to turn on or off based on the recording area.

* * * * *